US008151384B2

(12) United States Patent
Jankiewicz

(10) Patent No.: US 8,151,384 B2
(45) Date of Patent: Apr. 10, 2012

(54) SHOWER EXPANDER

(76) Inventor: John Jankiewicz, Northbrook, IL (US)

( * ) Notice: Subject to any disclaimer, the term of this patent is extended or adjusted under 35 U.S.C. 154(b) by 1257 days.

(21) Appl. No.: 11/848,804

(22) Filed: Aug. 31, 2007

(65) Prior Publication Data

US 2009/0056010 A1 Mar. 5, 2009

(51) Int. Cl.
*A47K 3/00* (2006.01)

(52) U.S. Cl. ..... 4/610

(58) Field of Classification Search ..... 4/610, 557–558, 4/607–608

See application file for complete search history.

(56) References Cited

U.S. PATENT DOCUMENTS

| | | | | |
|---|---|---|---|---|
| 699,786 | A | | 5/1902 | Campbell |
| 1,255,396 | A | | 2/1918 | Eaton |
| 1,971,802 | A | | 8/1934 | Zechiel |
| 2,032,180 | A | | 2/1936 | McCord |
| 2,185,305 | A | | 1/1940 | Marchand |
| 2,188,163 | A | * | 1/1940 | Sherman ..... 160/327 |
| 2,212,326 | A | | 8/1940 | Piken |
| 2,232,194 | A | | 2/1941 | Zogby |
| 2,239,630 | A | | 4/1941 | Tendrich et al. |
| 2,303,502 | A | | 12/1942 | Rous |
| 2,313,421 | A | | 3/1943 | Dalton, Jr. |
| 2,454,434 | A | | 11/1948 | Cunningham |
| 2,500,350 | A | | 3/1950 | Endres |
| 2,573,985 | A | | 11/1951 | Porter |
| 2,608,250 | A | | 8/1952 | Meyer |
| 2,613,368 | A | | 11/1952 | Rosenbaum |
| 2,668,298 | A | | 2/1954 | Kimmons |
| 2,751,150 | A | | 6/1956 | Buccicone |
| 2,771,945 | A | | 11/1956 | Wittrup |
| 2,774,974 | A | | 12/1956 | Zaloga |
| 2,776,439 | A | | 1/1957 | Rondinelli |
| 2,840,160 | A | | 6/1958 | Tichenor |
| 2,862,211 | A | * | 12/1958 | Shaberman et al. ..... 4/615 |
| 2,878,487 | A | * | 3/1959 | Foote ..... 4/610 |
| 3,104,014 | A | | 9/1963 | Piette |
| 3,418,665 | A | * | 12/1968 | Long ..... 4/610 |
| 3,808,610 | A | | 5/1974 | Mortensen |
| 3,872,520 | A | * | 3/1975 | Tyconik ..... 4/610 |
| 3,934,636 | A | | 1/1976 | Simmons |
| 4,070,735 | A | | 1/1978 | Canaday |
| 4,771,517 | A | | 9/1988 | Bonanno |

(Continued)

OTHER PUBLICATIONS http://www.moreshowerspace.com—"ShowerBow™" product description including artist rendering of product, Jul. 25, 2007.

(Continued)

*Primary Examiner* — Lori Baker

(74) *Attorney, Agent, or Firm* — Brinks Hofer Gilson & Lione

(57) ABSTRACT

A shower expander assembly is provided for use with a shower area having a curtain. The assembly has a coupling for connecting the assembly to a shower curtain rod. The assembly also has a pair of rods. A first rod is connected to the coupling and extends from the coupling. The first rod has a first end and a second end, and the first rod is connected to the coupling at the first end. A second rod is pivotally connected to the second end of the first rod. The second rod is movable between a storage position and a use position. The second rod is configured such that in the storage position the second rod is substantially parallel to the first rod and in the use position the second rod is not substantially parallel to the first rod.

20 Claims, 3 Drawing Sheets

U.S. PATENT DOCUMENTS

| | | | | | |
|---|---|---|---|---|---|
| 4,825,481 | A | | 5/1989 | Lonberger | |
| 4,888,835 | A | | 12/1989 | Baumann | |
| 5,007,120 | A | * | 4/1991 | Annand | 4/558 |
| 5,023,964 | A | | 6/1991 | Unsworth | |
| 5,033,132 | A | | 7/1991 | Greenblatt | |
| 5,083,330 | A | | 1/1992 | Dusar | |
| 5,216,766 | A | | 6/1993 | Lang | |
| 5,243,715 | A | | 9/1993 | Barmak | |
| 5,339,884 | A | | 8/1994 | Angerman | |
| 5,345,623 | A | | 9/1994 | Dearman | |
| 5,345,624 | A | * | 9/1994 | Brown, III | 4/610 |
| 5,345,992 | A | * | 9/1994 | Turner | 160/330 |
| 5,351,739 | A | | 10/1994 | Levy | |
| 5,365,619 | A | | 11/1994 | Solomon | |
| 5,402,842 | A | | 4/1995 | Ruggiero | |
| 5,421,393 | A | | 6/1995 | Wolfe | |
| 5,447,244 | A | * | 9/1995 | Mentzer | 211/123 |
| 5,495,628 | A | | 3/1996 | Logan | |
| 5,543,196 | A | * | 8/1996 | Robinson et al. | 428/99 |
| 5,651,407 | A | * | 7/1997 | Perez | 160/330 |
| 5,673,962 | A | | 10/1997 | Maieli et al. | |
| 5,771,504 | A | * | 6/1998 | Steiner | 4/558 |
| 5,787,954 | A | * | 8/1998 | Herrera | 160/330 |
| 5,809,589 | A | | 9/1998 | Johnson | |
| 5,901,769 | A | | 5/1999 | Farley | |
| 5,947,603 | A | | 9/1999 | Tilman | |
| 5,950,255 | A | | 9/1999 | Thompson | |
| 5,974,603 | A | | 11/1999 | Frazier | |
| 6,032,306 | A | * | 3/2000 | Gummin | 4/610 |
| 6,038,749 | A | * | 3/2000 | Eberhardt | 24/306 |
| 6,041,454 | A | * | 3/2000 | Summerford | 4/558 |
| 6,049,920 | A | * | 4/2000 | Mochizuki | 4/609 |
| 6,098,699 | A | | 8/2000 | Junius | |
| 6,163,899 | A | * | 12/2000 | Leonard | 4/558 |
| 6,192,965 | B1 | | 2/2001 | Hinds | |
| 6,289,967 | B1 | | 9/2001 | Moore | |
| 6,394,168 | B1 | | 5/2002 | Zoboski | |
| 6,488,070 | B1 | | 12/2002 | Cox | |
| 6,565,144 | B1 | | 5/2003 | Crean | |
| 6,845,525 | B2 | * | 1/2005 | Bathurst | 4/608 |
| 6,857,140 | B1 | * | 2/2005 | Broudy | 4/609 |
| 2006/0070177 | A1 | * | 4/2006 | Bathurst et al. | 4/558 |
| 2008/0184479 | A1 | * | 8/2008 | Bathurst | 4/610 |

OTHER PUBLICATIONS http://www.bedbathandbeyond.com/product—Product description and photograph of a contour curved shower rod, Apr. 4, 2007.

http://www.bedbathandbeyond.com/product—Product description and photograph of The Crescent Rod® Curved White Shower Rod, Apr. 4, 2007.

* cited by examiner

SHOWER EXPANDER

BACKGROUND

1. Field of the Invention

The present invention generally relates to accessories for use with a shower curtain. More specifically, the invention relates to shower accessories for use with a shower curtain that increase the useable space within a shower area.

2. Description of Related Art

A typical bath tub, which often doubles as a shower stall, is approximately twenty-seven (27) inches wide. As such, there may not be enough space for a user to move about without touching the side solid wall and the shower curtain, especially if the user has a large frame or has a disability. Further, the shower curtain may tend to draw inward, providing even less space for a user. Thus, a variety of mechanisms have been used to increase the space that a user may have within a shower area. Some devices involve tying the shower curtain to an outside object, which may interfere with the ability of another person to use the washroom simultaneously. Other devices may involve altering the construction of the shower curtain rod itself. However, it may be desirable to remove the expanding device when the device is not in use, especially in small washrooms. Still other devices have been provided that may be removed when not in use, however, these devices are often bulky and often occupy a substantial amount of space in the washroom even when they are not being used.

In view of the above, it is apparent that there exists a need for a shower expanding device that effectively increases the useable space within a shower area, while remaining compact both during use and storage of the device.

SUMMARY

In satisfying the above and other needs, as well as overcoming the enumerated drawbacks and other readily recognized limitations of the art, the present invention provides a shower expander assembly that is compact in use and more compact in storage. Further, the shower expander assembly may be manufactured inexpensively and not interfere with the ability of others to simultaneously use a washroom.

The shower expander assembly is intended for use with a shower area having a curtain. The shower expander assembly has a pair of rods and a coupling for connecting the assembly to a shower curtain rod. A first rod of the shower expander assembly is connected to the coupling and extends from the coupling. The first rod has a first end and a second end, the first rod being connected to the coupling at the first end. A second rod is pivotally connected to the second end of the first rod. The second rod is movable between a storage position and a use position. The second rod is configured such that in the storage position the second rod is substantially parallel to the first rod and in the use position the second rod is not substantially parallel to the first rod.

Further objects, features and advantages of this invention will become readily apparent to persons skilled in the art after a review of the following description, with reference to the drawings and claims that are appended to and form a part of this specification.

DETAILED DESCRIPTION

Figure 1:
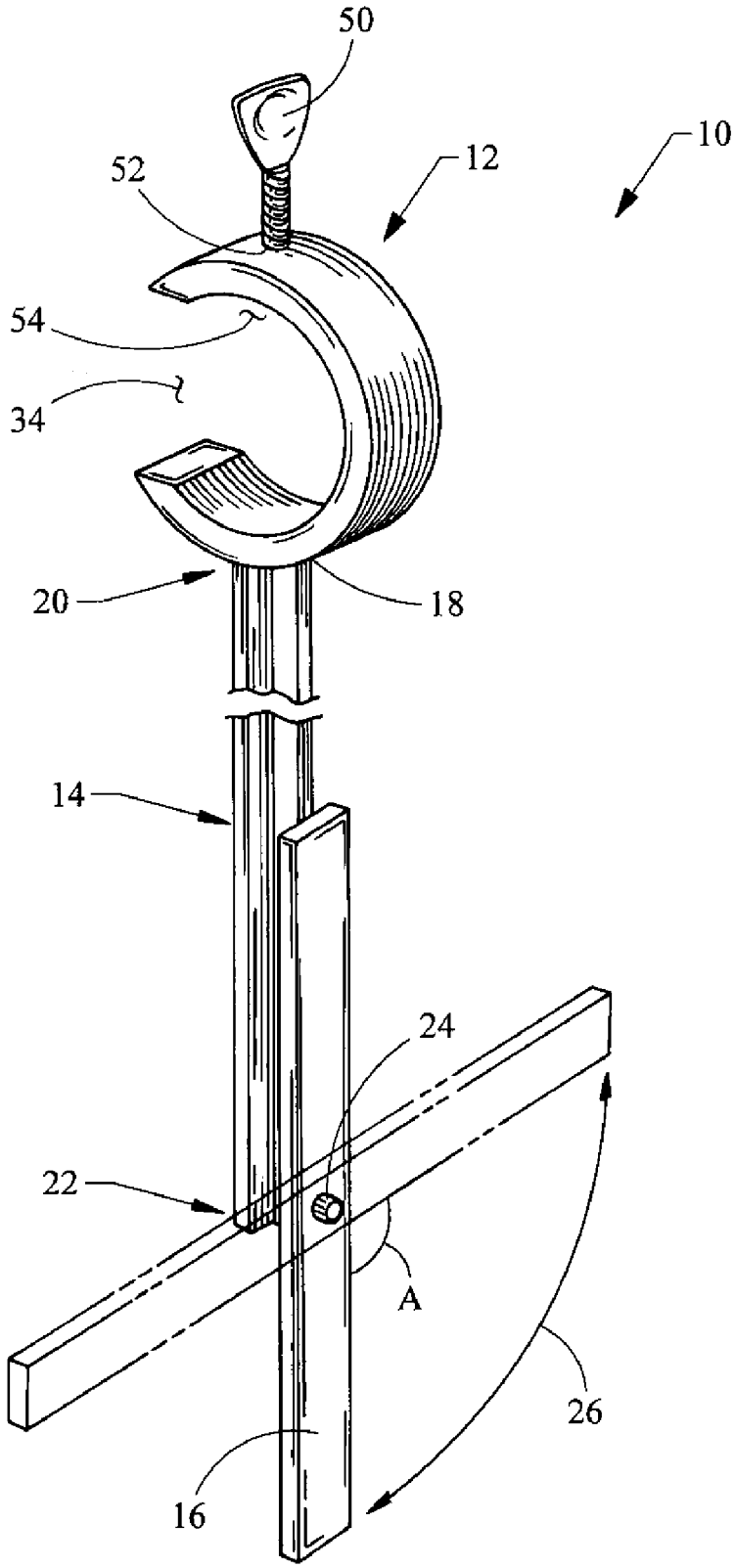
FIG. 1 is a perspective view of a shower expander assembly that may be in a storage position, with imaginary lines of the shower expander assembly that may be in a use position, embodying the principles of the present invention.

Referring now to FIG. 1, a shower expander assembly embodying the principles of the present invention is illustrated therein and designated at 10. The assembly 10 includes a coupling 12, a first rod 14, and a second rod 16. The first rod 14 is attached to the coupling 12 and extends from the coupling 12. Preferably the first rod 14 is connected to the coupling 12 with a rigid joint 18; however, it is contemplated that the joint 18 could have configurations that are not rigid, such as a joint that is moveable between a rigid position and a non-rigid position, without falling beyond the spirit and scope of the present invention. The rods 14, 16 may have any suitable cross-section, without falling beyond the spirit and scope of the present invention. For example, they could have a circular, rectangular, or triangular cross-section. Further, the rods 14, 16 are illustrated as being straight rods, but it is also contemplated that the rods 14, 16 could be curved or could have any other suitable configuration. The rods 14, 16 are preferably formed of high-impact plastic; however, any other suitable material may be used, without falling beyond the spirit and scope of the present invention.

The first rod 14 has a first end 20 and a second end 22. The first rod 14 is connected to the coupling 12 at its first end 20, and the first rod 14 is connected to the second rod 16 at its second end 22. As used herein, the terms first "end" and second "end" are to be construed liberally, such that the ends 20, 22 need not be at the very tip of the first rod 14, but may be merely near the tip of the first rod 14. For example, the second rod 16 is connected to the first rod 14, not at the very tip of the first rod 14, but at a location near the tip, as shown in FIG. 1.

The second rod 16 is pivotally connected to the second end 22 of the first rod 14. The second rod 16 may be pivotally connected at a pivot point 23 by a pin 24, as shown in FIG. 1. The pin 24 preferably has an interference fit with the rods 14, 16, such that some amount of force is required to rotate the second rod 16 about the pivot point 23. Instead of being connected by a pin 24, the second rod 16 may alternatively be pivotally connected to first rod 14 in any other suitable manner. For example, the first rod 14 could have holders integrally formed therewith to pivotally hold the second rod 16, or the second rod 16 could be connected by a set screw, a rivet, a bolt, or it could be integrally formed with one or more of the rods 14, 16, such as a channel in at least one rod into which the other rod is biased by way of a spring or the like. Preferably, the first and second rods 14, 16 are held together at the pivot point 23 with a snug interference fit, but in the alternative, the pivot point 23 could have a loose fit with a locking mechanism, such as a set screw or one or more channels into which one or both rods are biased thereinto, to hold the rods in the desired position.

The pivot point 23 is preferably located near the center of the second rod 16, as shown in FIG. 1. However, the pivot point 23 could be located at any other point along the second rod 16, without falling beyond the spirit and scope of the present invention. For example the pivot point 23 could be located an end of the second rod 16.

The second rod 16 is configured to pivot between a use position and a storage position, as indicated by the arrow 26 in FIG. 1. In the storage position, the second rod 16 is substantially parallel to the first rod 14. This substantially parallel configuration allows the assembly 10 to be neatly stored, which will be described in more detail below. In the use position, the second 16 may be pivoted along the pivot point 23, such that an angle A exists between the first rod 14 and the second rod 16. Preferably, the angle A is approximately 90 degrees, such that the second rod 16 is substantially perpendicular to the first rod 14 in the use position; in other words, the first and second rods 14, 16 form a "T" shape in the use position. See, e.g., FIG. 2A. In the alternative, it is contemplated that the angle A may be virtually any angle, without falling beyond the spirit and scope of the present invention; in other words, the rods 14, 16 could form a shape other than a "T" shape in the use position, such as an "X" shape.

Figure 2B:
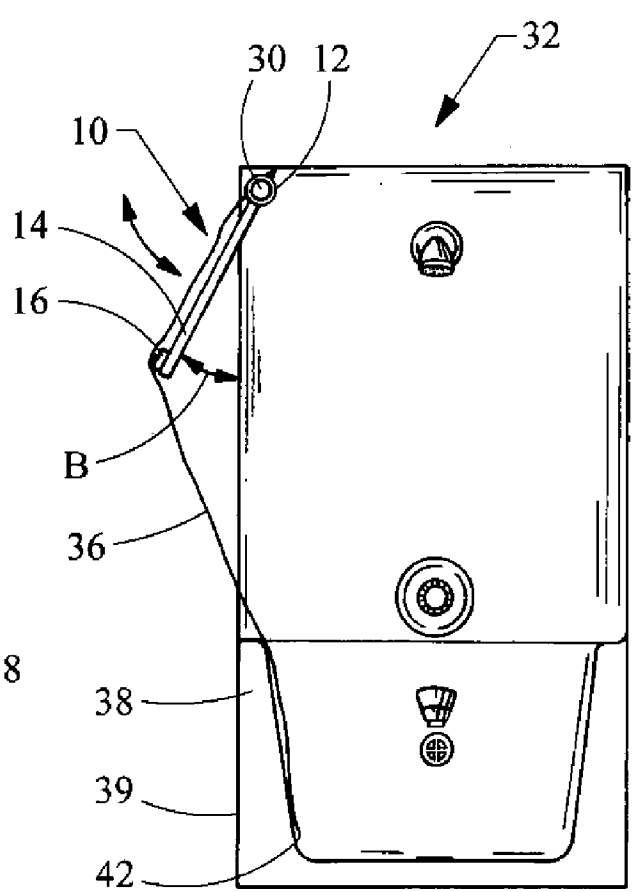
FIG. 2B is a side view of the shower area and shower expander assembly of FIG. 2A.
Figure 2A:
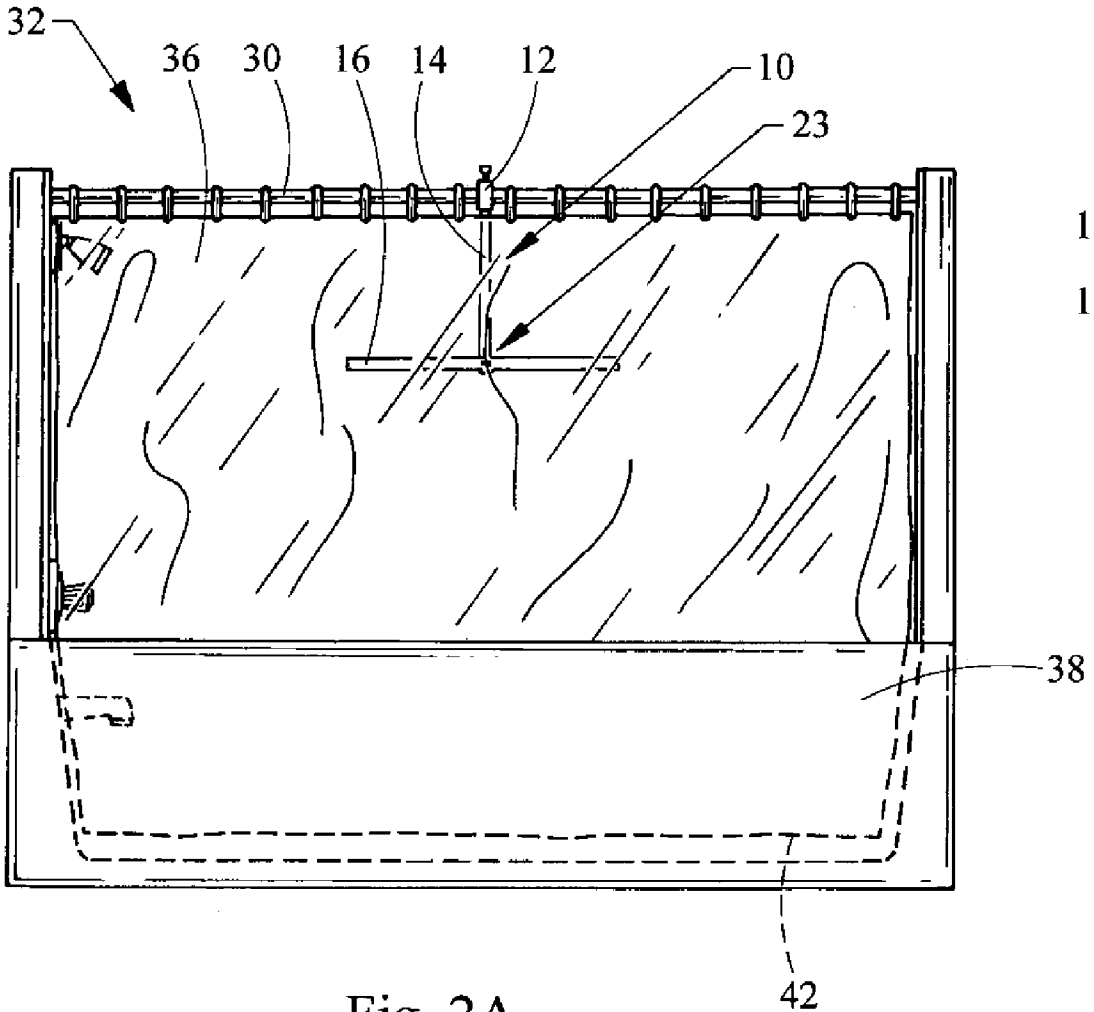
FIG. 2A is a front view of a shower area having the shower expander assembly of FIG. 1 installed therein.

With reference to FIGS. 1, 2A, and 2B, the coupling 12 is configured to be connected to a shower curtain rod 30 in a shower area 32. It is contemplated that the coupling 12 could be alternatively be connected to another member within the shower area 32, instead of the shower curtain rod 30, without falling beyond the spirit and scope of the present invention. The coupling 12 is configured to be removably attached to a shower curtain rod 30; in other words, a user may remove the coupling 12 from the shower curtain rod 30, if desired. To this end, the coupling 12 may have a variety of configurations within the spirit and scope of the present invention. For example, with reference to FIG. 1, the coupling has a "C" shape and is slightly deformable, so that the coupling 12 may slide on and off of a shower curtain rod 30 through the opening 34 of the coupling 12. Other variations of the coupling 12 will be described in further detail below.

When in the use position, the shower expander assembly 10 is configured to hold a shower curtain 36 outward from the shower area 32. With reference to FIG. 2B, the assembly 10 is held at an angle B from the plane of the edge 39 of the bath tub 38. The angle B could have any value between about 0 and about 180 degrees, and is preferably in the range of about 10 degrees to about 90 degrees. In this way, the assembly 10 operates to hold the shower curtain 36 out and away from the shower area 32, thereby increasing the space that an occupant has in the shower area 32. The shower curtain 36 is held outward, but the end 42 of the shower curtain 36 remains within the bath tub 38, because conventional shower curtains 38 are long enough to remain within the bath tub 38 even if held outward by the shower expander assembly 10.

The coupling 12 is configured to be attached to the shower curtain rod 30 in a rigidly attached position and a loosely attached position. This can be achieved in any suitable manner, and a few examples are provided herein. With reference to FIG. 1, the coupling 12 has a set screw 50. The set screw 50 may be screwed in and out of a threaded aperture 52. When the set screw 50 is screwed into the threaded aperture 52, the set screw 50 will extend through the coupling 12 into an inner space 54. When the coupling 12 is fitted around a shower curtain rod 30, the set screw 50 may be tightened until the set screw 50 contacts the shower curtain rod 30 firmly to hold the coupling 12 in a desired orientation. When a user desires to use the shower expander assembly 10, the user would preferably orient the coupling 12 so that the first rod 14 has an angle B, in the ranges described above, with respect to the plane of the bath tub edge 39. Alternatives to a set screw in a threaded aperture may be provided that nevertheless fall within the spirit and scope of the invention, such as a pin that is interference fit into an aperture.

When a user desires to store the shower expander assembly 10, the user loosens the set screw 50 until the coupling 12 loosely hangs from the shower curtain rod 30, in a loosely connected position. In the loosely connected position, the first rod 14 will hang straight downward due to gravitational forces thereon. The second rod 16 may then be rotated about the pivot point 23 until it is parallel with the first rod 14, and the shower expander assembly 10 is then fully in the storage position. The set screw 50 may be configured such that it is not removable from the coupling 12, which is a configuration that has the added benefit of keeping the set screw 50 attached to the coupling 12 to prevent loss. The loosened coupling may be slid to one end of the shower rod or, if the coupling provides sufficient clearance to do so, the coupling may be removed from the rod, if desired.

In this embodiment, the coupling 12 is shown having a "C" shape. It should be understood that the "C" shape could be a half cylinder, a ¾ cylinder, or it could comprise any other suitable portion of a cylinder. Further, the coupling 12 could have configurations other than that of a "C" shape. For example, the coupling 12 be a full cylindrical tube, which could be slid onto a shower rod from one end when the shower rod is detached from the wall.

Figure 3A:
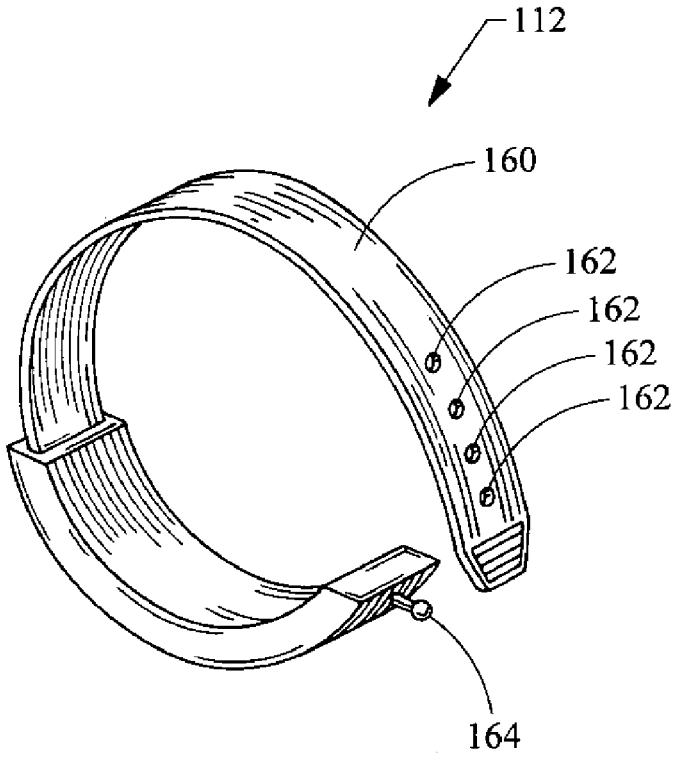
FIG. 3A is a perspective view of another coupling for use with a shower expander assembly embodying the principles of the present invention.

With reference to FIG. 3A, another coupling 112 for use with a shower expander assembly 10 is illustrated. The coupling 112 has a flexible strap 160, which is preferably formed of a plastic, elastic, or elastomeric material. The flexible strap 160 has a plurality of apertures 162, which are configured to be inserted over a connecting pin 164. When a user desires to install the coupling 12 in the rigidly attached position, so that he/she may use the shower expander assembly 10, the user secures the connecting pin 164 within an aperture 162 such that the flexible strap is tightly held over a shower curtain rod 30. When the flexible strap 160 is attached to the connecting pin 164 to hold the coupling 12 tightly to the shower curtain rod 130, the coupling 112 stays in the desired rotational position after the user releases his/her grip on the assembly 10 if the flexible strap 160 is connected with sufficient tightness. To release the coupling 112, the user pulls the flexible strap 160 away from the connecting pin 164.

Figure 3B:
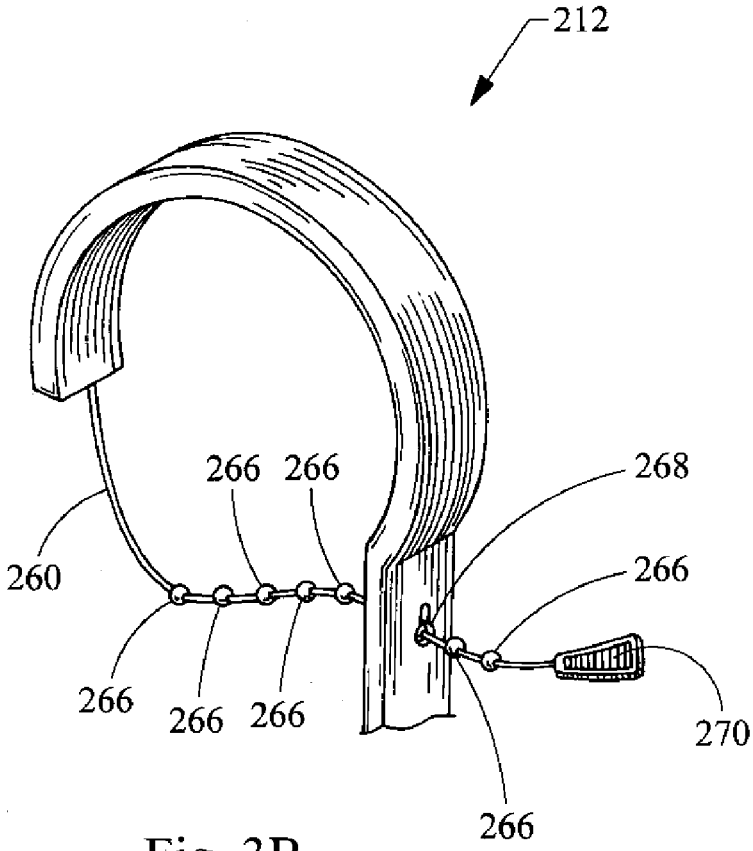
FIG. 3B is a perspective view of yet another coupling for use with a shower expander assembly embodying the principles of the present invention.

With reference to FIG. 3B, another coupling 212 for use with a shower expander assembly 10 is illustrated. The coupling 212 has a flexible strap 260, which is preferably formed of a plastic, elastic, or elastomeric material. The flexible strap 260 has a plurality of circular bulges 266. The flexible strap 260 is configured to be inserted through an aperture 268 on the coupling 212. When a user desires to hold the coupling 212 in a rigidly attached position to use the shower expander assembly 10, the user pulls the flexible strap 260 through the aperture 268, using the pull tab 270, until a sufficient number of bulges 266 are pulled through the aperture 268 to secure the coupling 212 tightly to the shower curtain rod 30. The bulges 266 may be pulled back through the aperture 268 in the opposite direction to release the coupling 212.

From the above description, it can be seen that the shower expander assembly 10 is operable between a use position and a storage position, and a user may easily convert the assembly 10 between the two positions. The assembly 10 allows a shower area 32 to be expanded, without altering the shower curtain rod 30 or the shower curtain 38. Further, the shower expander assembly 10 is relatively compact, especially in the storage position. When a user puts the shower expander assembly 10 into the use position, the user gains more space to move about the shower area 32.

Although various examples were given of the coupling 12, 112, 212, it should be understood that any suitable configuration of the coupling 12, 112, 212 may be used. Other suitable configurations may include a clamp, a bolt, or an interference fit between the shower curtain rod 30 and the coupling. The preferable attributes of the coupling 12, 112, 212 include that it be detachable from the shower curtain rod 30 after being attached thereto, and that it be moveable between a rigidly attached position and a loosely attached position on the shower curtain rod 30.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

I claim:

1. A shower expander assembly for use with a shower area having a curtain, the assembly comprising:

a coupling for connecting the assembly to a shower curtain rod;

a first rod connected to the coupling and extending from the coupling, the first rod having a first end and a second end, the first rod being connected to the coupling at the first end;

a second rod pivotally connected to the second end of the first rod, the second rod having a first end and a second end, the second rod being movable within a plane between a storage position and a use position, the second rod being configured such that in the storage position the second rod is substantially parallel to the first rod and in the use position the second rod is not substantially parallel to the first rod;

wherein, in the use position, the first end of the second rod extends past a first side of the first rod, and the second end of the second rod extends past a second side of the first rod opposite the first side.

2. The shower expander assembly of claim 1, wherein the second rod is configured such that in the use position the second rod is substantially perpendicular to the first rod.

3. The shower expander assembly of claim 1, wherein the second rod has a pivot point located substantially near the center of the second rod, the second rod being connected to the first rod at the pivot point.

4. The shower expander assembly of claim 1, wherein the coupling is configured to be removably attached to a shower curtain rod.

5. The shower expander assembly of claim 1, wherein the coupling is configured to attach to a shower curtain rod in a rigidly attached position and a loosely attached position.

6. The shower expander assembly of claim 5, wherein the coupling has a set screw configured to rigidly attach the coupling to a shower curtain rod when screwed into the rigidly attached position, the set screw further configured to release the coupling from rigid attachment to the shower curtain rod in the loosely attached position when unscrewed from the rigidly attached position.

7. The shower expander assembly of claim 5, wherein the coupling has a flexible strap.

8. The shower expander assembly of claim 7, wherein the flexible strap has a plurality of apertures and a connecting pin configured to mate with an aperture of the plurality of apertures.

9. The shower expander assembly of claim 7, wherein the coupling has an aperture through which the flexible strap is inserted.

10. The shower expander assembly of claim 4, wherein the coupling has a "C" shape.

11. The shower expander assembly of claim 10, wherein the coupling has a set screw configured to rigidly attach the coupling to a shower curtain rod when screwed into the rigidly attached position, the set screw further configured to release the coupling from rigid attachment to the shower curtain rod in the loosely attached position when unscrewed from the rigidly attached position.

12. The shower expander assembly of claim 1, wherein the first rod is rigidly attached to the coupling.

13. The shower expander assembly of claim 12, wherein the coupling has a set screw configured to rigidly attach the coupling to a shower curtain rod when screwed into the rigidly attached position, the set screw further configured to release the coupling from rigid attachment to the shower curtain rod in the loosely attached position when unscrewed from the rigidly attached position.

14. The shower expander assembly of claim 13, wherein the coupling has a "C" shape.

15. The shower expander assembly of claim 12, wherein the coupling has a "C" shape.

16. The shower expander assembly of claim 15, wherein the coupling is configured to attach to a shower curtain rod in a rigidly attached position and a loosely attached position.

17. The shower expander assembly of claim 16, wherein the coupling has a set screw configured to rigidly attach the coupling to a shower curtain rod when screwed into the rigidly attached position, the set screw further configured to release the coupling from rigid attachment to the shower curtain rod in the loosely attached position when unscrewed from the rigidly attached position.

18. The shower expander assembly of claim 15, wherein the coupling has a flexible strap.

19. The shower expander assembly of claim 18, wherein the flexible strap has a plurality of apertures and a connecting pin configured to mate with an aperture of the plurality of apertures.

20. The shower expander assembly of claim 18, wherein the coupling has an aperture through which the flexible strap is inserted.

* * * * *